US010162298B2

(12) United States Patent
Kawakami

(10) Patent No.: US 10,162,298 B2
(45) Date of Patent: Dec. 25, 2018

(54) IMAGE FORMING APPARATUS WITH IMAGE TWO-DIMENSIONAL CORRECTION

(71) Applicant: Konica Minolta, Inc., Chiyoda-ku, Tokyo (JP)

(72) Inventor: Yoshiteru Kawakami, Hino (JP)

(73) Assignee: Konica Minolta, Inc., Chiyoda-ku, Tokyo (JP)

( * ) Notice: Subject to any disclaimer, the term of this patent is extended or adjusted under 35 U.S.C. 154(b) by 0 days.

(21) Appl. No.: 15/664,220

(22) Filed: Jul. 31, 2017

(65) Prior Publication Data

US 2018/0039214 A1 Feb. 8, 2018

(30) Foreign Application Priority Data

Aug. 8, 2016 (JP) ..... 2016-155959

(51) Int. Cl.
*G03G 15/00* (2006.01)
*B65H 1/00* (2006.01)

(52) U.S. Cl.
CPC ..... *G03G 15/5062* (2013.01); *B65H 1/00* (2013.01); *G03G 15/5029* (2013.01); *G03G 15/6529* (2013.01); *G03G 15/6567* (2013.01); *G03G 15/6564* (2013.01); *G03G 2215/00721* (2013.01)

(58) Field of Classification Search
CPC ..... G03G 15/5062; G03G 15/6529
See application file for complete search history.

(56) References Cited

U.S. PATENT DOCUMENTS

2010/0295241 A1* 11/2010 Isogai ..... B65H 9/006 271/227
2012/0057913 A1* 3/2012 Kawachi ..... B65H 9/006 399/394
2012/0112405 A1* 5/2012 Hirota ..... B65H 7/08 271/227
2013/0134663 A1* 5/2013 Deno ..... B65H 9/002 271/228

FOREIGN PATENT DOCUMENTS

JP 2000-242124 A 9/2000

* cited by examiner

*Primary Examiner* — Benjamin Schmitt
*Assistant Examiner* — Milton Gonzalez
(74) *Attorney, Agent, or Firm* — Buchanan Ingersoll & Rooney PC

(57) ABSTRACT

An image forming apparatus includes: an image forming part that forms an image on a sheet; a conveyor that conveys the sheet on which the image is formed by the image forming part; a corrector including a swing member that moves the sheet conveyed by the conveyor in a main scanning direction of the image; and a hardware processor that rotates the image formed on the sheet after timing at which the swing member loses contact with the sheet when the swing member separates from the sheet or the sheet is conveyed to pass through the swing member in accordance with a bending amount of the sheet.

5 Claims, 13 Drawing Sheets

IMAGE FORMING APPARATUS WITH IMAGE TWO-DIMENSIONAL CORRECTION

Japanese Patent Application No. 2016-155959 filed on Aug. 8, 2016, including description, claims, drawings, and abstract the entire disclosure is incorporated herein by reference in its entirety.

BACKGROUND

Technological Field

The present invention relates to an image forming apparatus that forms an image by transferring a toner image to a sheet to fix.

Description of the Related Art

In related art, an image forming apparatus that forms an image on a sheet using toner is known. In such an image forming apparatus, a correcting unit including a registration roller that corrects inclination of the sheet, deviation of a position in a width direction of the sheet in a main scanning direction of the image, a transfer unit that forms an image on the sheet, and a fixer that fixes the image formed on the sheet by the transfer unit.

In the correcting unit provided with the registration roller, the deviation of the sheet is corrected by moving the registration roller that nips the sheet in an axial direction. In operation of moving the sheet in the width direction, in order to reduce resistance of movement of the sheet, it is configured such that a roller on an upstream side of the registration roller is separated from the sheet. Also, after correcting the deviation of the sheet, operation of separating the registration roller from the sheet and returning the same to an initial position is performed. In this manner, on the upstream side of the transfer unit, the roller that conveys the sheet is separated from the sheet.

In the image forming apparatus, occurrence of paper wrinkling by a fixing roller and image bending is inhibited by adjusting alignment of the registration roller, a transfer roller forming the transfer unit, and the fixing roller forming the fixer. However, difference in roller diameter between front and back and the like due to roller accuracy at the time of exchange of the fixing roller and the like, assembling accuracy, uneven wear and the like occurs with time.

Therefore, an alignment adjusting mechanism of a fixer that adjusts a position in a conveying direction of a sheet and a vertical direction orthogonal to the conveying direction by using a motor and a solenoid is suggested (refer, for example, to JP 2000-242124 A).

However, the alignment adjusting mechanism provided with a driving mechanism such as the motor and the solenoid has a large number of parts and a complicated structure, so that a product cost increases.

Also, while the sheet is nipped to be conveyed by the registration roller, the sheet is inhibited from bending during conveyance, and bending of the image to be formed on the sheet is inhibited. However, when the registration roller loses contact with the sheet because the registration roller separates from the sheet for returning to its initial position or a rear end of the sheet passes through the registration roller, there is possibility that the sheet bends during the formation of the image under an effect of the inclination, deformation and the like of the fixing roller.

When the sheet bends during the formation of the image, the image formed on the sheet bends and a quality is deteriorated. In recent years, demand is increasing also for sheets referred to as long paper larger than a size that may be accommodated in a paper feed cassette. However, a sheet such as the long paper which is long in the conveying direction tends to be remarkably bent on a rear end side especially before image formation, and bending of the image is noticeable.

SUMMARY

The present invention has been achieved to solve such a problem, and an object thereof is to provide an image forming apparatus.

To achieve the abovementioned object, according to an aspect of the present invention, an image forming apparatus reflecting one aspect of the present invention comprises: an image forming part that forms an image on a sheet; a conveyor that conveys the sheet on which the image is formed by the image forming part; a corrector including a swing member that moves the sheet conveyed by the conveyor in a main scanning direction of the image; and a hardware processor that rotates the image formed on the sheet after timing at which the swing member loses contact with the sheet when the swing member separates from the sheet or the sheet is conveyed to pass through the swing member in accordance with a bending amount of the sheet.

BRIEF DESCRIPTION OF THE DRAWING

The advantages and features provided by one or more embodiments of the invention will become more fully understood from the detailed description given hereinbelow and the appended drawings which are given by way of illustration only, and thus are not intended as a definition of the limits of the present invention.

DETAILED DESCRIPTION OF EMBODIMENTS

Hereinafter, one or more embodiments of an image forming apparatus according to the present invention will be described with reference to the drawings. However, the scope of the invention is not limited to the disclosed embodiments.

<Configuration Example of Image Forming Apparatus of this Embodiment>

Figure 1:
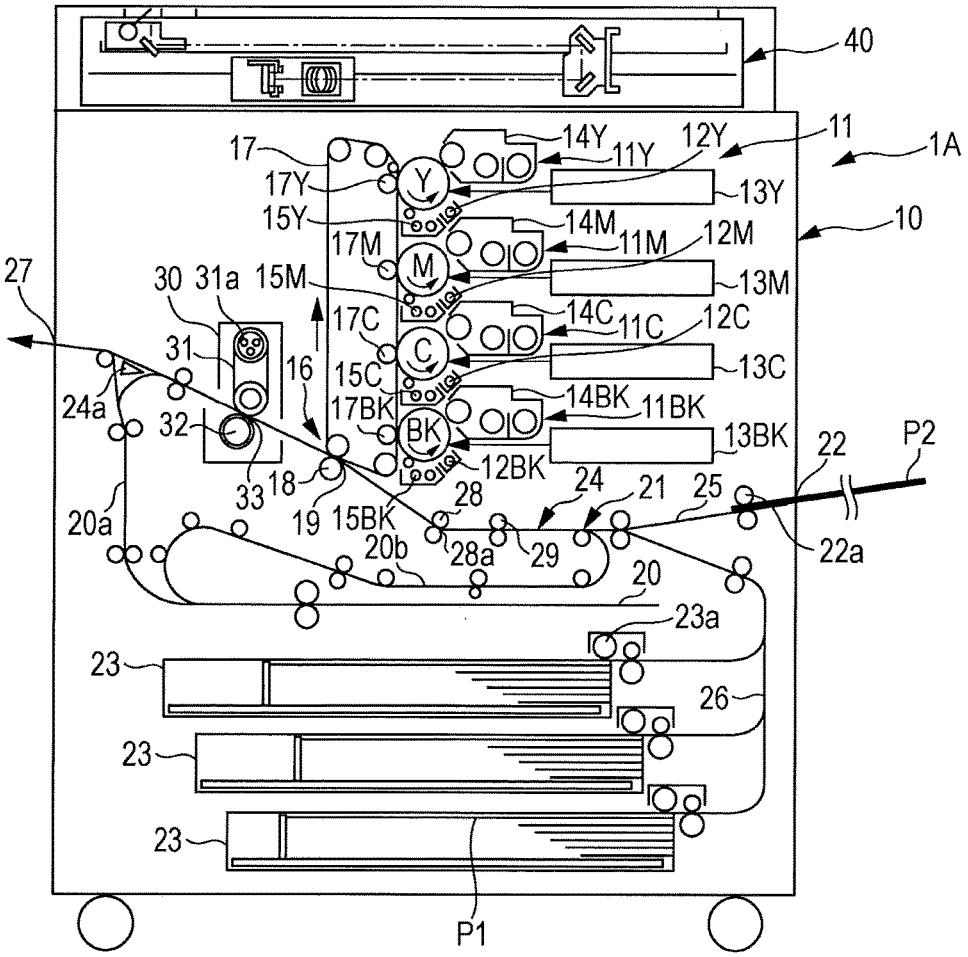
FIG. 1 is a configuration diagram illustrating an example of an image forming apparatus of this embodiment.

FIG. 1 is a configuration diagram illustrating an example of an image forming apparatus of this embodiment. An image forming apparatus 1A of this embodiment being an electrophotographic image forming apparatus is a so-called tandem color image forming apparatus in which a plurality of photoreceptors is arranged in a longitudinal direction so as to be opposed to a single intermediate transfer belt to form a full-color image in this example.

The image forming apparatus 1A is hereinafter described in detail. The image forming apparatus 1A includes an image forming part 11 that forms an image on a sheet cut into a predetermined length such as paper P1 and long paper P2 or roll paper. The image forming apparatus 1A also includes a conveyor 21 that conveys the sheet and the like. In the following description, a sheet P is described as an example of a target on which an image is formed.

First, a configuration of forming an image on the sheet P is described. The image forming part 11 being an example of an image forming unit forms an image on the sheet P by charging, exposure, development, transfer and fixing processes. The image forming part 11 includes a toner image forming part 11Y that forms a yellow (Y) toner image, a toner image forming part 11M that forms a magenta (M) toner image, a toner image forming part 11C that forms a cyan (C) toner image, and a toner image forming part 11BK that forms a black (BK) toner image.

The toner image forming part 11Y includes a photoreceptor drum Y and a charging unit 12Y arranged around the same, an optical writing unit 13Y, a developing device 14Y, and a drum cleaner 15Y. Similarly, the toner image forming parts 11M, 11C, and 11BK include photoreceptor drums M, C, and BK and charging units 12M, 12C, and 12BK arranged around the same, optical writing units 13M, 13C, and 13BK, developing devices 14M, 14C, and 14BK, and drum cleaners 15M, 15C, and 15BK, respectively.

The developing devices 14Y, 14M, 14C, and 14BK are examples of a developing unit, and the developing device 14Y supplies the photoreceptor drum Y being a photoreceptor with toner. Also, the developing device 14M supplies the photoreceptor drum M being the photoreceptor with toner, the developing device 14C supplies the photoreceptor drum C being the photoreceptor with toner, and the developing device 14BK supplies the photoreceptor drum BK being the photoreceptor with toner.

The photoreceptor drum Y is an example of a first image carrier; a surface thereof is uniformly charged by the charging unit 12Y, and a latent image is formed on the photoreceptor drum Y by scanning exposure by the optical writing unit 13Y. The photoreceptor drum Y is supplied with the toner from the developing device 14Y, and the latent image is developed to be visualized. As a result, the toner image corresponding to yellow is formed as an image of a predetermined color on the photoreceptor drum Y.

The photoreceptor drum M is an example of the first image carrier; a surface thereof is uniformly charged by the charging unit 12M, and a latent image is formed on the photoreceptor drum M by scanning exposure by the optical writing unit 13M. The photoreceptor drum M is supplied with the toner from the developing device 14M, and the latent image is developed to be visualized. As a result, the toner image corresponding to magenta is formed as an image of a predetermined color on the photoreceptor drum M.

The photoreceptor drum C is an example of the first image carrier; a surface thereof is uniformly charged by the charging unit 12C, and a latent image is formed on the photoreceptor drum C by scanning exposure by the optical writing unit 13C. The photoreceptor drum C is supplied with the toner from the developing device 14C, and the latent image is developed to be visualized. As a result, the toner image corresponding to cyan is formed as an image of a predetermined color on the photoreceptor drum C.

The photoreceptor drum BK is an example of the first image carrier; a surface thereof is uniformly charged by the charging unit 12BK, and a latent image is formed on the photoreceptor drum BK by scanning exposure by the optical writing unit 13BK. The photoreceptor drum BK is supplied with the toner from the developing device 14BK, and the latent image is developed to be visualized. As a result, the toner image corresponding to black is formed as an image of a predetermined color on the photoreceptor drum BK.

The image forming part 11 includes a transfer unit 16 that transfers the image to the sheet P. The transfer unit 16 being an example of a transfer unit includes an intermediate transfer belt 17 on which the images formed on the photoreceptor drums Y, M, C, and BK are primarily transferred, and a secondary transfer roller 18 that secondarily transfers the images primarily transferred to the intermediate transfer belt 17 to the sheet P.

The intermediate transfer belt 17 being an example of a second image carrier is arranged on a side opposed to one surface of the sheet P conveyed by the conveyor 21. The images formed on the photoreceptor drums Y, M, C, and BK are sequentially transferred to a predetermined position of the intermediate transfer belt 17 by the primary transfer rollers 17Y, 17M, 17C, and 17BK when the intermediate transfer belt 17 is driven in a direction indicated by an arrow.

The secondary transfer roller 18 being an example of a secondary transfer unit is arranged so as to be opposed to the intermediate transfer belt 17 on a side opposed to the other surface of the sheet P conveyed by the conveyor 21. The transfer unit 16 is such that the secondary transfer roller 18 is arranged so as to be movable in a direction to come into contact with and separate from the intermediate transfer belt 17 and when the secondary transfer roller 18 is pressed against the intermediate transfer belt 17, a transfer nip unit 19 is formed.

The secondary transfer roller 18 applies positive voltage from a side of the other surface of the sheet P. As a result, one surface serving as an image forming surface to which the image is transferred of the sheet P passing between the secondary transfer roller 18 and the intermediate transfer belt 17 is negatively charged and the other surface thereof is positively charged.

In the transfer nip unit 19, the secondary transfer roller 18 is rotary driven at the same speed as that of the intermediate transfer belt 17 in synchronization with conveyance of the sheet P by the conveyor 21. As a result, the sheet P conveyed by the conveyor 21 enters between the secondary transfer roller 18 and the intermediate transfer belt 17. This is pressed against the intermediate transfer belt 17 by the secondary transfer roller 18. Therefore, the images of the respective colors primarily transferred to the intermediate transfer belt 17 are secondarily transferred to the sheet P conveyed between the intermediate transfer belt 17 and the secondary transfer roller 18 and an image is formed on the sheet P.

The image forming apparatus 1A includes a fixer 30 that fixes the image on the sheet P. The fixer 30 being an example of a fixing unit performs a fixing process to fix the image on the sheet P on which the image is formed. The fixer 30 includes a fixing belt 31 that heats the sheet P and a pressure roller 32 that presses the sheet P against the fixing belt 31.

The fixing belt 31 being an example of a heating rotor is provided on a side opposed to one surface of the sheet P on which the image is formed by the transfer unit 16; a temperature of the fixing belt 31 to be applied to the sheet P is controlled by control of energization to a heater 31*a*. The pressure roller 32 being an example of a pressure rotor is arranged on a side opposed to the other surface of the sheet P. The fixing belt 31 and the pressure roller 32 are rotary driven independently.

The fixer 30 is such that the pressure roller 32 is brought into pressure contact with the fixing belt 31, thereby forming a fixing nip unit 33. In a state in which the pressure roller 32 is brought into pressure contact with the fixing belt 31, the pressure roller 32 is rotary driven and the heater 31*a* is energized, so that the sheet P nipped by the fixing nip unit 33 is conveyed and the image is fixed on the sheet P by pressure and heat.

Next, a configuration to convey the sheet P is described. The image forming apparatus 1A includes an external paper feeder 22 through which the long paper P2 being an example of the sheet P is fed and a paper feed cassette 23 accommodating the paper P1 being another example of the sheet P. The external paper feeder 22 is provided on one side of an apparatus main body 10. The paper feed cassette 23 is provided on a lower portion of the apparatus main body 10 so as to be drawable.

In the image forming apparatus 1A, the long paper P2, a length in a conveying direction of which exceeds a first length capable of being accommodated in the paper feed cassette 23 in this example is fed from outside the apparatus main body 10 through the external paper feeder 22. Also, in the image forming apparatus 1A, the paper P1, a length in the conveying direction of which is the maximum length which may be accommodated in the paper feed cassette 23 and is equal to or less than the first length is fed from the paper feed cassette 23 inside the apparatus main body 10.

The conveyor 21 being an example of a conveying unit includes a main conveyance path 24 on which the sheet P on which an image is formed by the image forming part 11 is conveyed and a reversal conveyance path 20 for reversing the sheet P.

The conveyor 21 also includes an external paper feed conveyance path 25 for conveying the sheet P such as the long paper P2 fed through the external paper feeder 22 to the main conveyance path 24 and a paper feed conveyance path 26 for conveying the paper P1 fed from the paper feed cassette 23 to the main conveyance path 24.

One end of the main conveyance path 24 is connected to the external paper feed conveyance path 25 and the paper feed conveyance path 26. Also, the other end of the main conveyance path 24 is connected to a discharge port 27 arranged on the other side of the apparatus main body 10.

One end of the external paper feed conveyance path 25 is connected to the external paper feeder 22 and the other end thereof is connected to the main conveyance path 24. An upper end of the paper feed conveyance path 26 is connected to the main conveyance path 24 and a lower end thereof is connected to the paper feed cassette 23.

The conveyor 21 includes a registration roller 28 that corrects inclination of the sheet P referred to as skew and deviation of a position with respect to a main scanning direction of the image being a width direction of the sheet P orthogonal to the conveying direction of the sheet P conveyed in a forward direction on the main conveyance path 24. The conveyor 21 also includes a loop roller 29 that allows the sheet P to abut the registration roller 28.

The registration roller 28 being an example of a swing member that forms a correcting unit is formed of a pair of rollers opposed to each other with the sheet P being conveyed on the main conveyance path 24 interposed therebetween. The registration roller 28 having an axis extending in the main scanning direction of the image formed on the sheet P conveys the sheet P in a direction orthogonal to the axis.

The registration roller 28 is such that a pair of rollers is configured so as to be movable in a direction to come into contact with and separate from each other by a driving mechanism not illustrated and a pair of rollers is brought into pressure contact with each other to form a nip unit 28*a*. The sheet P abuts the nip unit 28*a* in a state in which the rotation of the registration roller 28 is stopped, so that the inclination of the sheet P is corrected. Also, the sheet P enters between a pair of rollers which is brought into pressure contact with each other, so that the registration roller 28 nips the sheet P and conveys the sheet P by rotation.

Also, the registration roller 28 corrects the position of the sheet P in the main scanning direction by nipping the sheet P and moving in the axial direction. Furthermore, after correcting the position of the sheet P in the main scanning direction, a pair of rollers of the registration roller 28 separates from each other to move in the axial direction to return to its initial position independently from the conveyance of the sheet P.

The loop roller 29 forming a correcting unit is formed of a pair of rollers opposed to each other with the sheet P conveyed on the main conveyance path 24 interposed therebetween is arranged on an upstream side of the registration roller 28 in the conveying direction of the sheet P. The loop roller 29 has an axis extending in the main scanning direction of the image formed on the sheet P and conveys the sheet P in a direction orthogonal to the axis.

The sheet P is conveyed by the loop roller 29 in a state in which the registration roller 28 is stopped, and a tip end of the sheet P is allowed to abut the nip unit 28*a* formed of abutting portions of a pair of rollers, and the sheet P is conveyed to reach a curved state referred to as a loop, so that the inclination in the direction along the surface of the sheet P is corrected.

After the inclination of the sheet P is corrected, the registration roller 28 is rotary driven in the conveying direction of the sheet P, so that the sheet P is nipped and conveyed. Furthermore, by moving the registration roller 28 in the axial direction, the position of the sheet P in the main scanning direction is corrected. As described above, a series of paper position correcting operation to correct the inclination of the sheet P and the deviation of the position in the main scanning direction is referred to as registration swing.

The reversal conveyance path 20 includes a first return conveyance path 20*a* branching from the main conveyance path 24 on a downstream side of the fixer 30 and a second return conveyance path 20*b* joining in the main conveyance path 24 on an upstream side of the transfer unit 16.

In the image forming apparatus 1A, an image is formed on an upper surface of the sheet P conveyed on the main conveyance path 24 in the forward direction to pass through the fixer 30. In a case of forming images on both surfaces of the sheet P, the sheet P on which an image is formed on one surface facing upward is conveyed from the main conveyance path 24 to the reversal conveyance path 20 through the first return conveyance path 20*a*. Then, the conveying direction of the sheet P is reversed and the sheet P is conveyed from the reversal conveyance path 20 to the main conveyance path 24 through the second return conveyance path 20*b*, so that the image forming surface faces downward. As a result, the sheet P is reversed, and it becomes possible to form an image on the other surface facing upward.

The conveyor 21 includes a switching gate 24*a* for switching the conveying direction in a position where the first return conveyance path 20*a* branches from the main conveyance path 24, and the conveyance path is switched on the basis of setting such as presence/absence of double-sided printing.

The image forming apparatus 1A includes a document reader 40. The document reader 40 scans to expose an image of a document by an optical system of a scanning exposing device and reads reflected light by a line image sensor, thereby obtaining an image signal. Meanwhile, the image forming apparatus 1A may have a configuration in which an automatic document conveying device not illustrated that feeds the document is provided in an upper portion thereof.

<Example of Control Function of Image Forming Apparatus of This Embodiment>

Figure 2:
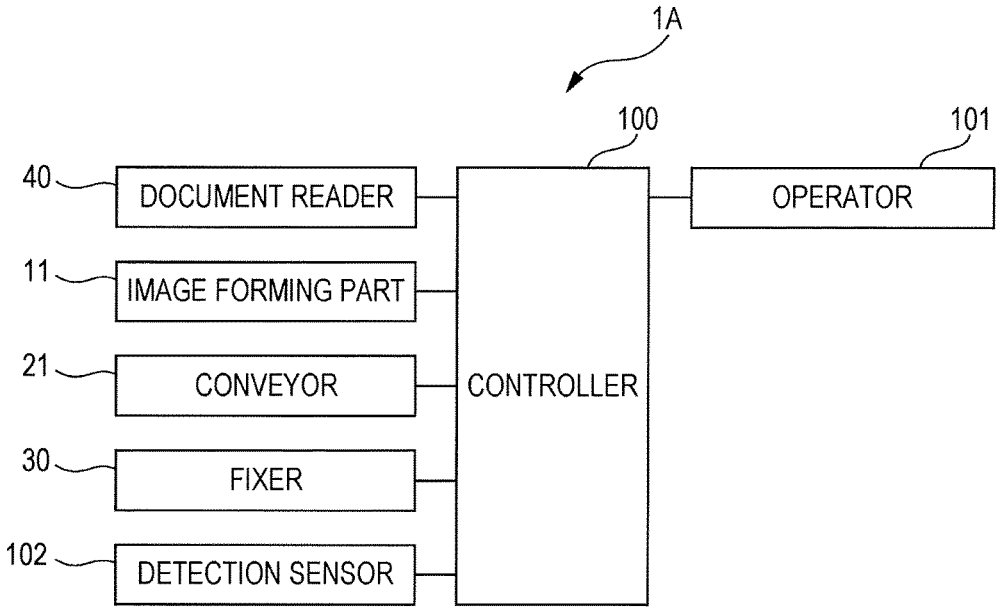
FIG. 2 is a functional block diagram illustrating an example of a control function of the image forming apparatus of this embodiment.

FIG. 2 is a functional block diagram illustrating an example of a control function of the image forming apparatus of this embodiment. The image forming apparatus 1A includes a controller 100 that performs a series of control to feed the sheet P, form an image, and discharge the sheet. The controller 100 being an example of a control unit includes a microprocessor referred to as a CPU and an MPU, and a memory such as a RAM and a ROM as a storage unit.

The image forming apparatus 1A also includes an operator 101 that performs various types of operation such as setting of a type and a basis weight of the sheet P on which the image is formed, setting of the number of images to be formed and the like. Furthermore, the image forming apparatus 1A includes a detection sensor 102 that detects the position of the sheet P in the main scanning direction, a bending amount of the sheet P and the like. The detection sensor 102 is an example of a detecting unit and the bending amount of the sheet P is detected by the two detection sensors 102 provided in the conveying direction of the sheet P. Meanwhile, as the detecting unit, an image formed on the sheet P may be read and the bending amount of the sheet P may be detected from the image.

When a rear end of the sheet P conveyed on the main conveyance path 24 passes the registration roller 28, the sheet P loses contact with the registration roller 28. Also, after correcting the position of the sheet P in the main scanning direction, when the registration roller 28 separates, the sheet P loses contact with the registration roller 28.

The controller 100 controls a direction and the like of an image transferred to the intermediate transfer belt 17 such that the image transferred from the intermediate transfer belt 17 to the sheet P at timing at which the sheet P loses contact with the registration roller 28 corresponds to bending of the sheet P.

Figure 3A:
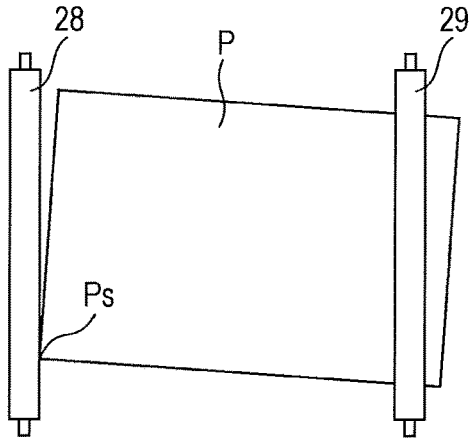
FIGS. 3A to 3C are illustration diagrams illustrating an example of registration swing.
Figure 3B:
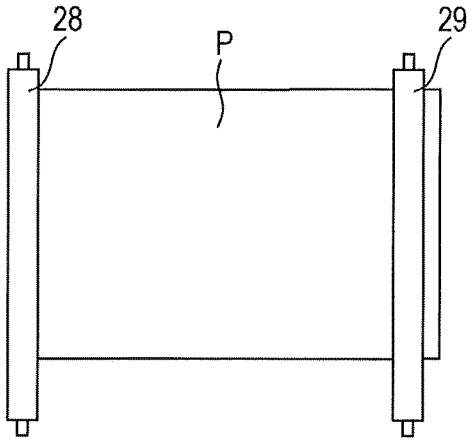
Figure 3C:
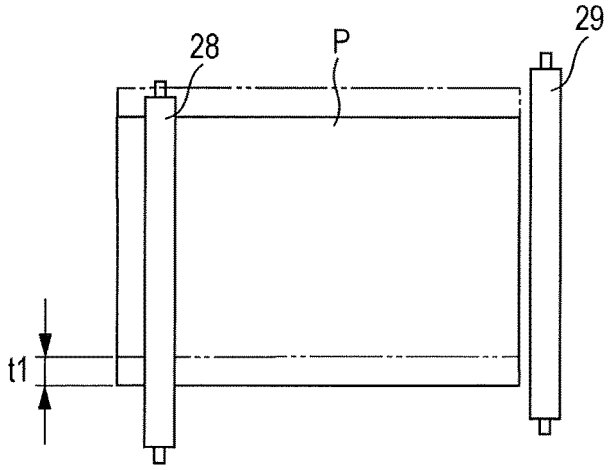

FIGS. 3A to 3C are illustration diagrams illustrating an example of registration swing. In a state in which the registration roller 28 stops, when the sheet P inclined in a planar direction is conveyed by the loop roller 29 as illustrated in FIG. 3A, a tip end Ps of the sheet P is allowed to abut the nip unit of the registration roller 28 and the inclination of the sheet P is corrected as illustrated in FIG. 3B.

When performing the registration swing, the controller 100 detects the position of the sheet P in the main scanning direction of the image by the detection sensor 102 and obtains a correction amount t1 by which the image forming position and the position of the sheet P in the main scanning direction are aligned on the basis of the position of the sheet P in the main scanning direction detected by the detection sensor 102.

The controller 100 moves the registration roller 28 in the axial direction by the correction amount t1 based on the position of the sheet P in the main scanning direction detected by the detection sensor 102, thereby aligning the image forming position with the position of the sheet P in the main scanning direction as illustrated in FIG. 3C.

<Example of Operation of Image Forming Apparatus of This Embodiment>

Figure 4:
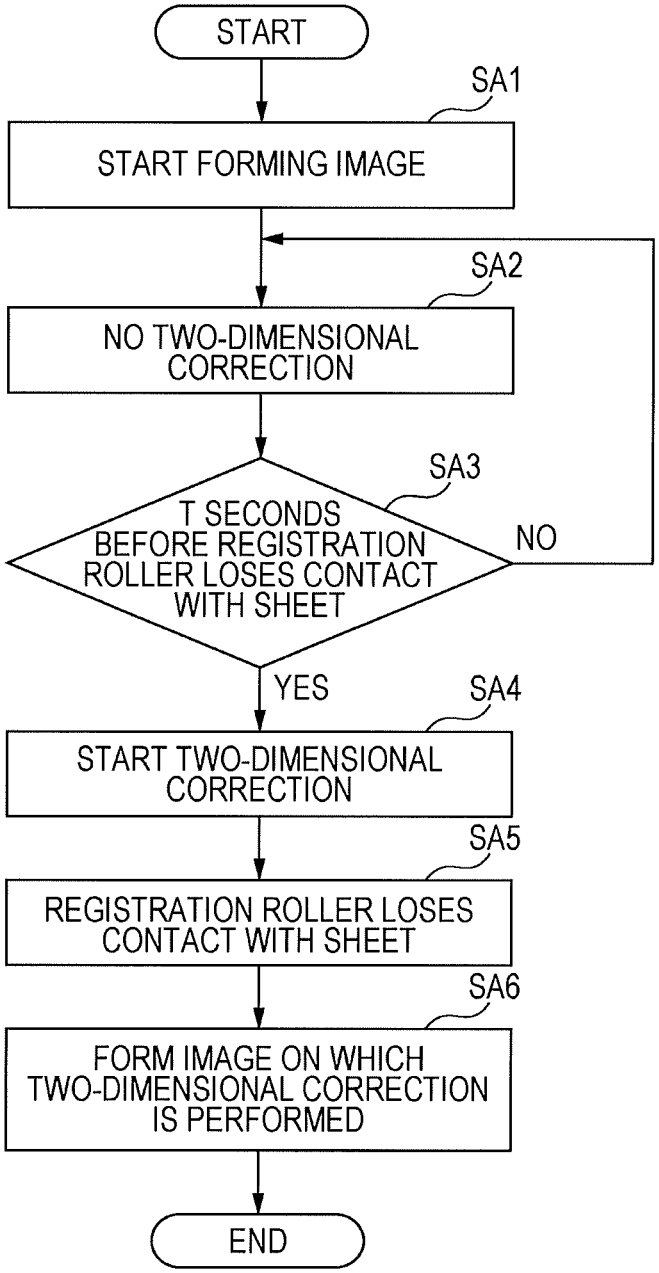
FIG. 4 is a flowchart illustrating an example of operation of the image forming apparatus of this embodiment.

FIG. 4 is a flowchart illustrating an example of operation of the image forming apparatus of this embodiment, and FIGS. 5 and 6A to 6C are operation illustration diagrams illustrating an example of the operation of the image forming apparatus of this embodiment; the operation of the image forming apparatus of this embodiment is hereinafter described with reference to the drawings.

Figure 5:
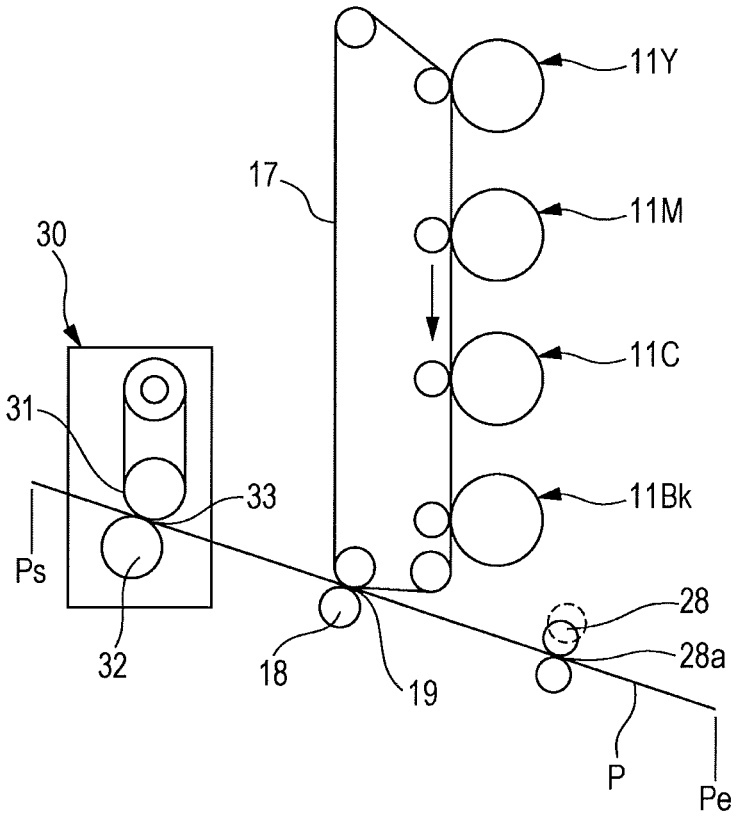
FIG. 5 is an operation illustration diagram illustrating an example of the operation of the image forming apparatus of this embodiment.

As illustrated in FIG. 5, the image forming apparatus 1A is configured to form an image on the sheet P by primarily transferring the image to the intermediate transfer belt 17 by each of the toner image forming parts 11Y, 11M, 11C, and 11BK and secondarily transferring the images from the intermediate transfer belt 17 to the sheet P by the transfer nip unit 19.

When a rear end Pe of the sheet P conveyed on the main conveyance path 24 passes through the registration roller 28 or when the registration roller 28 separates after correcting the position of the sheet P in the main scanning direction, the sheet P loses contact with the registration roller 28.

While the sheet P is nipped to be conveyed by the registration roller 28, the sheet P is held in a state in which the inclination thereof is corrected. On the other hand, when the sheet P loses contact with the registration roller 28, the sheet P might bend while being conveyed by the fixer 30 under an effect of an assembly error of each part of the fixer 30, deformation of the pressure roller 32 and the like.

Therefore, the controller 100 makes it possible to transfer the image rotated according to the bending of the sheet P to the sheet P in accordance with the timing at which the sheet P loses contact with the registration roller 28, so that it becomes possible to form the image the inclination of which is corrected in accordance with the bending of the sheet P when the sheet P is bent during the conveyance by the fixer 30. Such correction is referred to as two-dimensional correction.

It takes predetermined time from the transfer of the image to the intermediate transfer belt 17 by each of the toner image forming parts 11Y, 11M, 11C, and 11BK to the transfer of the image from the intermediate transfer belt 17 to the sheet P by the transfer nip unit 19. This time is a value according to a distance from a position where the image is primarily transferred to the intermediate transfer belt 17 by each of the toner image forming parts 11Y, 11M, 11C, and 11BK and a position of the transfer nip unit 19 being a position where the image is secondarily transferred to the sheet P by the intermediate transfer belt 17 and a feeding speed of the intermediate transfer belt 17.

Assuming that time required from the transfer of the image to the intermediate transfer belt 17 until the formation of an image Pc by the transfer of the image from the intermediate transfer belt 17 to the sheet P by the transfer nip unit 19 is T seconds, it becomes possible to form the image the inclination of which is corrected according to the bending of the sheet P by rotating the image to be transferred to the intermediate transfer belt 17 T seconds before the sheet P loses contact with the registration roller 28.

When the image forming apparatus 1A is a tandem color image forming apparatus, for example, time required from primary transfer of the image to the intermediate transfer belt 17 by the toner image forming part 11Y until secondary transfer of the image from the intermediate transfer belt 17 to the sheet P by the transfer nip unit 19 is Ty seconds.

In this case, by rotating the image to be transferred to the intermediate transfer belt 17 by the toner image forming part 11Y Ty seconds before the sheet P loses contact with the registration roller 28, it becomes possible to form the image the inclination of which is corrected according to the bending of the sheet P.

In the image forming apparatus 1A, the distances from the toner image forming parts 11Y, 11M, 11C, and 11BK to the transfer nip unit 19 are different from one another, so that the timing at which the image to be transferred to the intermediate transfer belt 17 is rotated is different for each toner image forming part.

Therefore, the timing at which the image to be transferred onto the intermediate transfer belt 17 is rotated is set for each of the toner image forming parts 11Y, 11M, 11C, and 11BK on the basis of the timing at which the sheet P loses contact with the registration roller 28.

Specific operation of the two-dimensional correction is hereinafter described. When operation of forming an image is started at step SA1 in FIG. 4, the registration swing is first performed on the sheet P. An image is transferred to the sheet P the inclination and the like of which is corrected by the registration swing by the intermediate transfer belt 17, so that the image is formed on the sheet P. After the registration swing, while the sheet P is nipped to be conveyed by the registration roller 28, the image Pc is formed without the two-dimensional correction at step SA2 in FIG. 4.

When it is determined to be T seconds before the sheet P loses contact with the registration roller 28 at step SA3 in FIG. 4, the image to be transferred to the intermediate transfer belt 17 is rotated by a correction value of the two-dimensional correction at step SA4. A rotational direction and a rotational amount of the image are determined on the basis of a bending direction and the bending amount of the sheet detected by a preceding sheet, for example.

When the image forming apparatus 1A is the tandem color image forming apparatus, images are transferred to the intermediate transfer belt 17 in order of the toner image forming parts 11Y, 11M, 11C, and 11Bk according to a feeding direction of the intermediate transfer belt 17 indicated by the arrow. Therefore, when it is determined to be Ty seconds before the sheet P loses contact with the registration roller 28, the image to be transferred to the intermediate transfer belt 17 by the toner image forming part 11Y is rotated.

When the intermediate transfer belt 17 is fed together with the conveyance of the sheet P and when it is determined to be Tm (<Ty) seconds before the sheet P loses contact with the registration roller 28, the image to be transferred to the intermediate transfer belt 17 by the toner image forming part 11M is rotated.

When the intermediate transfer belt 17 is fed together with the conveyance of the sheet P and when it is determined to be Tc (<Tm) seconds before the sheet P loses contact with the registration roller 28, the image to be transferred to the intermediate transfer belt 17 by the toner image forming part 11C is rotated.

When the intermediate transfer belt 17 is fed together with the conveyance of the sheet P and when it is determined to be Tbk (<Tc) seconds before the sheet P loses contact with the registration roller 28, the image to be transferred to the intermediate transfer belt 17 by the toner image forming part 11Bk is rotated.

Figure 6A:
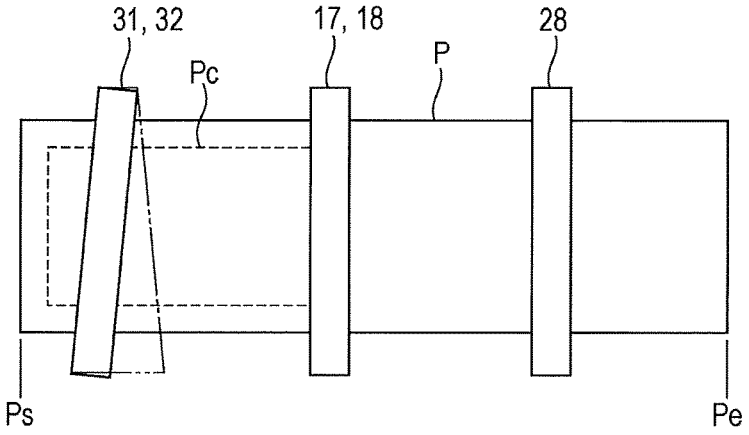
FIGS. 6A to 6C are operation illustration diagrams illustrating an example of the operation of the image forming apparatus of this embodiment.

FIG. 6A illustrates a state in which the sheet P is nipped by the registration roller 28. While the sheet P is nipped by the registration roller 28, the sheet P on which an image is formed by the transfer nip unit 19 is conveyed by the registration roller 28.

Figure 6B:
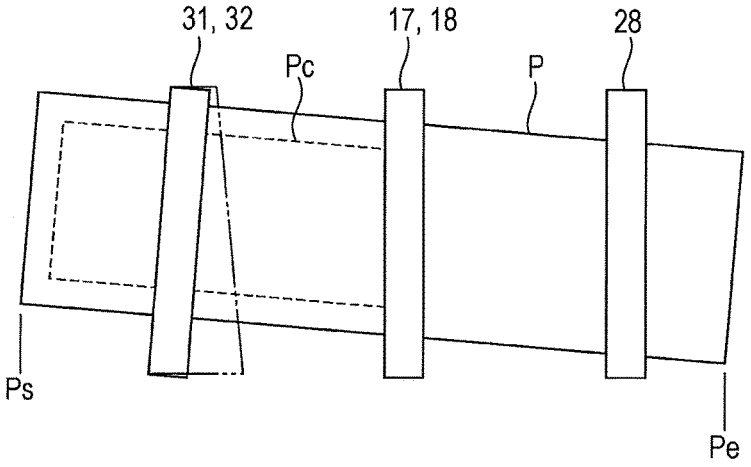
Figure 6C:
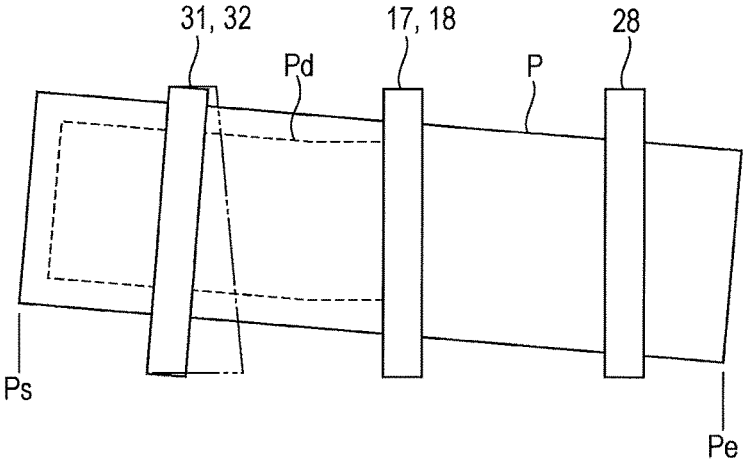

FIGS. 6A, 6B, and 6C illustrate an example in which axial directions of the fixing belt 31 and the pressure roller 32 are not orthogonal to the conveying direction of the sheet P and are inclined in the fixer 30.

In such a case, when the tip end Ps of the sheet P passes through the fixer 30 and the sheet P is nipped between the fixing belt 31 and the pressure roller 32, the tip end side of the sheet P on which the image Pc is formed bends under an effect of the fixer 30.

On the other hand, while the sheet P is nipped to be conveyed by the registration roller 28, the bending of the sheet P on a rear end side from the position where the image is formed by the transfer of the image by the transfer nip unit 19 is inhibited and a state in which the inclination of the sheet P is corrected by the registration swing is held.

According to this, the image Pc formed on the sheet P by the intermediate transfer belt 17 does not bend with respect to the sheet P. Meanwhile, the same applies to a case where a shape is deformed such that diameters are different between one side and the other side in the axial direction because the pressure roller 32 is deviated to be worn as indicated by two-dot chain lines in FIGS. 6A, 6B, and 6C.

FIG. 6B illustrates a case where the image Pc on which the two-dimensional correction is performed is formed in a state in which the sheet P loses contact with the registration roller 28 since the registration roller 28 separates from the sheet. Also, FIG. 6C illustrates a case where an image Pd on which the two-dimensional correction is not performed is formed in a state in which the sheet loses contact with the registration roller 28 since the registration roller 28 separates from the sheet P. Meanwhile, the same applies to a case where the sheet P loses contact with the registration roller 28 since the rear end Pe of the sheet P passes through the registration roller 28.

As illustrated in FIGS. 6A, 6B and 6C, when the axial directions of the fixing belt 31 and the pressure roller 32 are inclined, when the sheet P loses contact with the registration roller 28, the sheet P bends by the conveyance by the fixer 30. When the sheet P bends during the formation of the image, when the two-dimensional correction is not performed, as illustrated in FIG. 6C, the image Pd formed on the sheet P bends in midstream.

On the other hand, when the two-dimensional correction to rotate the image formed on the sheet P is performed at the timing at which the sheet P loses contact with the registration roller 28, when the sheet P loses contact with the registration roller 28 at step SA5 in FIG. 4, the rear end side of the sheet P bends, and the image Pc on which the two-dimensional correction is performed is formed on the sheet P at step SA6 in FIG. 4. As a result, as illustrated in FIG. 6B, the image Pc formed on the sheet P is inhibited from bending in midstream.

<Variation of Image Forming Apparatus of This Embodiment>

FIGS. 7A and 7B and FIGS. 8A and 8B are illustration diagrams illustrating another operation example of the image forming apparatus of this embodiment illustrating operation of controlling a correction value of secondary correction on the basis of stiffness of a sheet P affecting a bending amount of the sheet P.

When the stiffness of the sheet P is low, the sheet P easily bends. Therefore, as illustrated in FIG. 7B, a loop Ru is likely to be formed between a transfer nip unit 19 and a fixing nip unit 33, so that this is easily affected by an assembly error of each part of a fixer 30, deformation of a pressure roller 32 and the like.

Figure 7A:
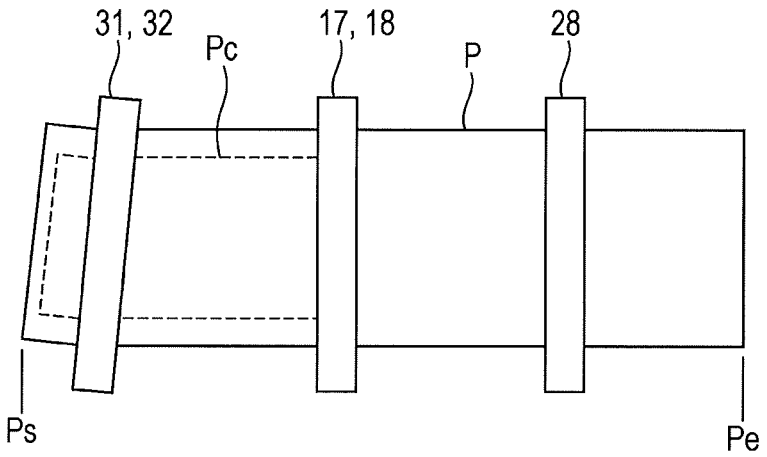
FIGS. 7A and 7B are operation illustration diagrams illustrating another operation example of the image forming apparatus of this embodiment.
Figure 7B:
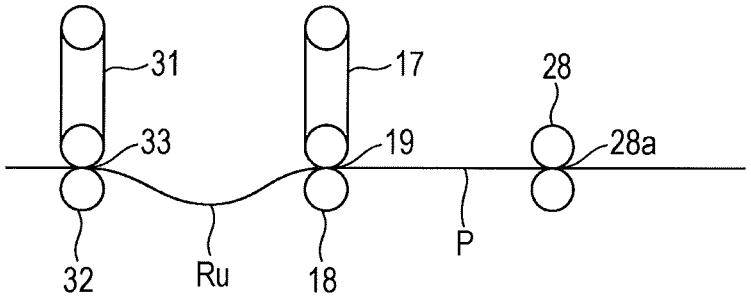

As a result, as illustrated in FIG. 7A, when axial directions of a fixing belt 31 and the pressure roller 32 are inclined, a bending amount of the sheet P after the sheet P loses contact with a registration roller 28 becomes large.

On the other hand, when the stiffness of the sheet P is high, the sheet P is less likely to bend. Therefore, as illustrated in FIG. 8B, since the loop Ru formed between the transfer nip unit 19 and the fixing nip unit 33 is small, this is less likely to be affected by the assembly error of each part of the fixer 30, the deformation of the pressure roller 32 and the like.

Figure 8A:
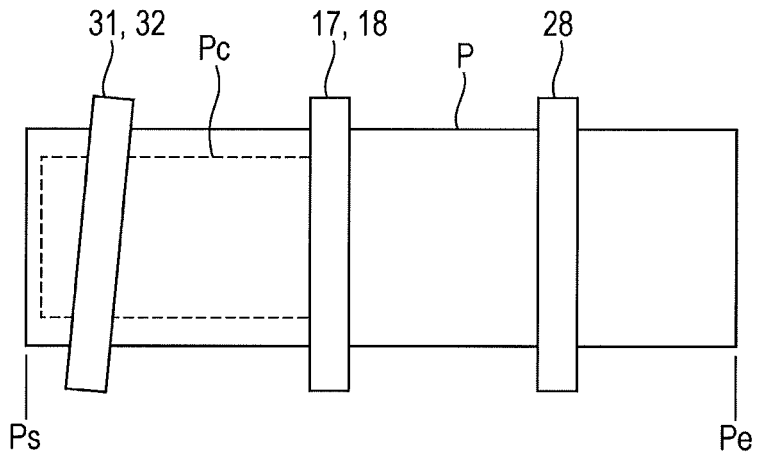
FIGS. 8A and 8B are operation illustration diagrams illustrating another operation example of the image forming apparatus of this embodiment.
Figure 8B:
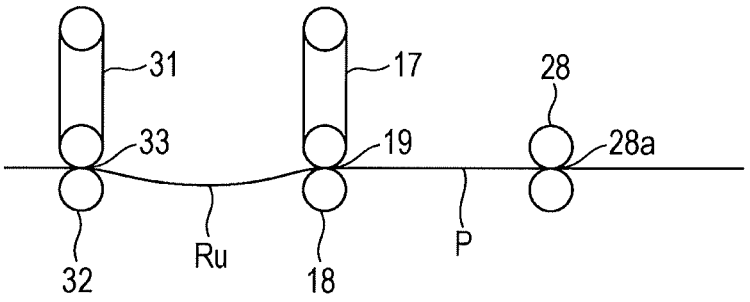

As a result, as illustrated in FIG. 8A, when the axial directions of the fixing belt 31 and the pressure roller 32 are inclined, the bending amount of the sheet P after the sheet P loses contact with the registration roller 28 becomes small.

Therefore, a controller 100 determines the stiffness of the sheet P on the basis of setting information such as a type, a basis weight and the like of the sheet P set by an operator 101, and switches a rotational amount of the image in two-dimensional correction according to the stiffness of the sheet P by making the same large/small when the stiffness of the sheet P is low/high.

As a result, an image Pc on which the two-dimensional correction is performed according to the bending amount of the sheet P due to the difference in stiffness is formed on the sheet P, and the image Pc formed on the sheet P is inhibited from bending in midstream.

Figure 9A:
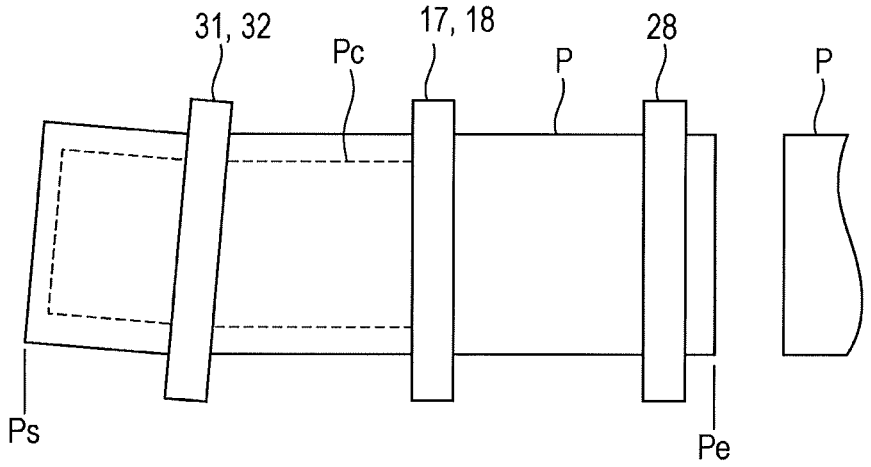
FIGS. 9A and 9B are operation illustration diagrams illustrating another operation example of the image forming apparatus of this embodiment.
Figure 9B:
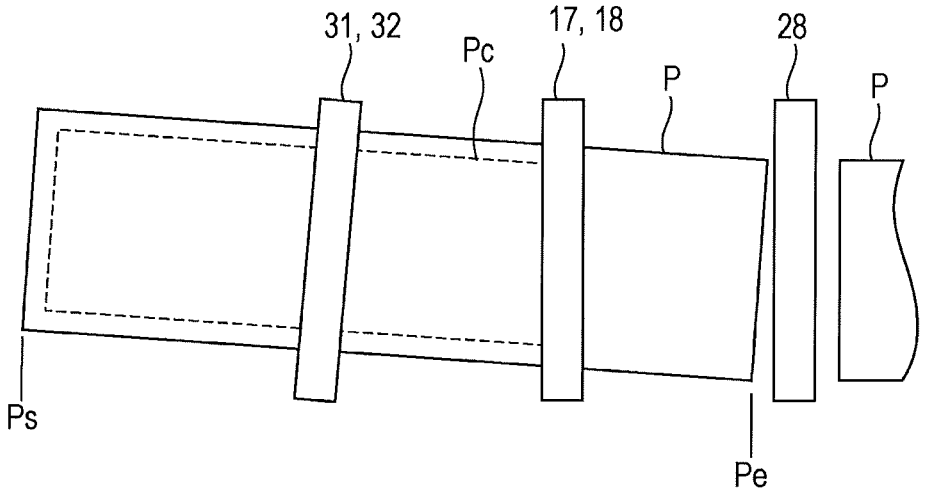

FIGS. 9A and 9B are operation illustration diagrams illustrating another operation example of the image forming apparatus of this embodiment illustrating operation of inhibiting the bending amount of the sheet P. As described above, when the registration roller 28 separates from the sheet P and the sheet P loses contact with the registration roller 28, an entire sheet P might bend under an effect of an assembly error of each part of the fixer 30, the deformation of the pressure roller 32 and the like.

The registration roller 28 returns to its initial position before a tip end of a next sheet P reaches the registration roller 28 after registration swing. Therefore, as illustrated in FIG. 9A, after the registration swing, timing to separate the registration roller 28 from the sheet P is delayed in accordance with time to return the registration roller 28 to its initial position. As a result, as illustrated in FIG. 9B, the bending amount of the sheet P after the registration roller 28 is separated from the sheet P is inhibited.

Figure 10:
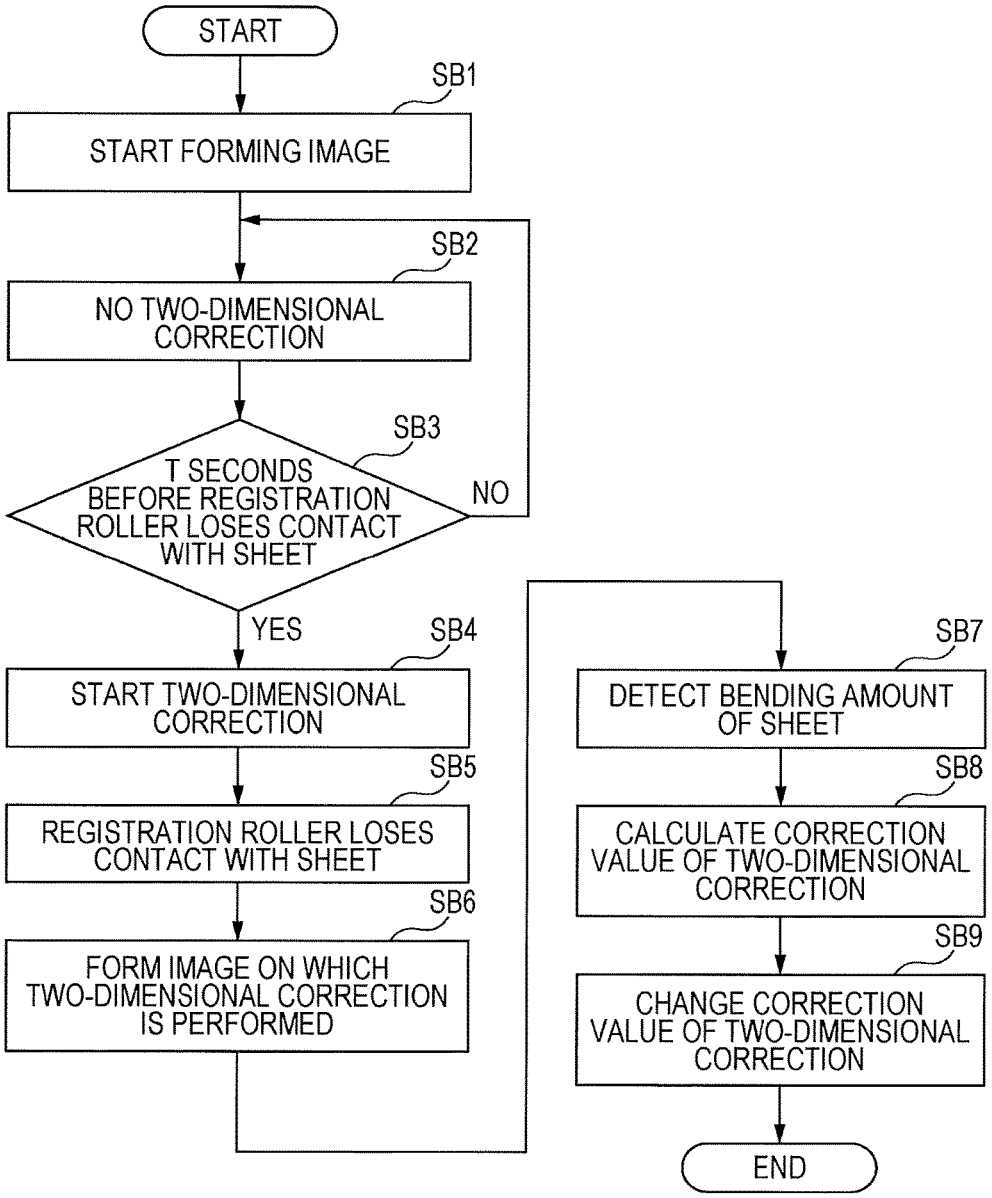
FIG. 10 is a flowchart illustrating another operation example of the image forming apparatus of this embodiment.

FIG. 10 is a flowchart illustrating another operation example of the image forming apparatus of this embodiment illustrating operation of determining the correction amount of the two-dimensional correction of the sheet P by the sheet P on which the image is being formed. When operation of forming an image is started at step SB1 in FIG. 10, the registration swing is first performed on the sheet P. An image is transferred to the sheet P the inclination and the like of which is corrected by the registration swing by the intermediate transfer belt 17, so that the image is formed on the sheet P. After the registration swing, while the sheet P is nipped to be conveyed by the registration roller 28, the image Pc is formed without the two-dimensional correction at step SB2 in FIG. 10.

When it is determined to be T seconds before the sheet P loses contact with the registration roller 28 at step SB3 in FIG. 10, the image to be transferred to the intermediate transfer belt 17 is rotated based on the correction value of the two-dimensional correction at step SB4.

When the two-dimensional correction to rotate the image formed on the sheet P is performed at the timing at which the sheet P loses contact with the registration roller 28, when the sheet P loses contact with the registration roller 28 at step SB5 in FIG. 10, a rear end side of the sheet P is bent and the image Pc on which the two-dimensional correction is performed is formed on the sheet P at step SB6 in FIG. 10.

The controller 100 detects the bending amount of the sheet P by a detection sensor 102 at step SB7 in FIG. 10.

The controller 100 obtains a rotational direction and a rotational amount of the image as the correction value in the two-dimensional correction from the bending amount of the sheet P at step SB8 in FIG. 10 and changes the correction value to a new value to perform the two-dimensional correction at step SB9.

As a result, the correction value of the two-dimensional correction may be determined according to an actual bending amount of the sheet P, so that the two-dimensional correction may be performed more accurately.

Figure 11:
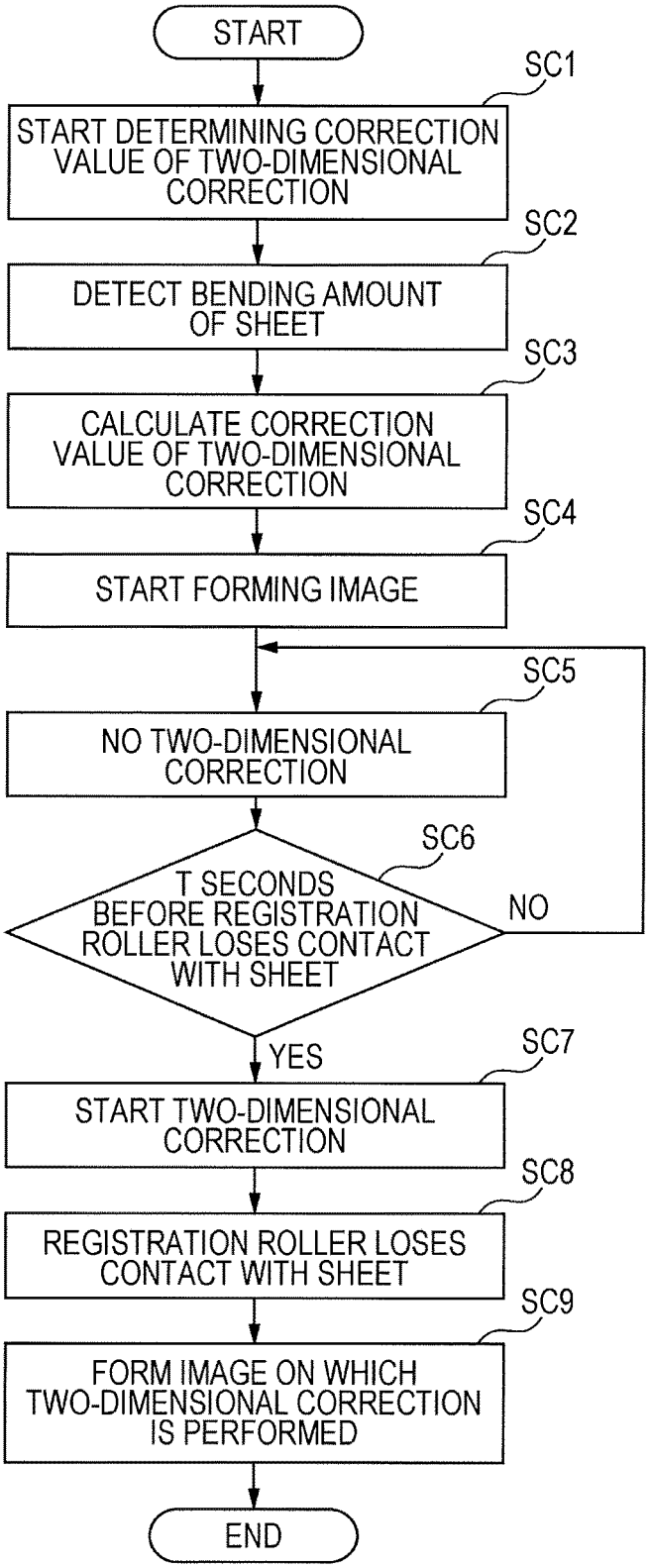
FIG. 11 is a flowchart illustrating another operation example of the image forming apparatus of this embodiment.

FIG. 11 is a flowchart illustrating another operation example of the image forming apparatus of this embodiment illustrating operation of determining the correction amount of the two-dimensional correction of subsequent sheets by a preceding sheet P. The sheet P is conveyed for determining the correction value of the two-dimensional correction at step SC1 in FIG. 11. The controller 100 detects the bending amount of the sheet P by the detection sensor 102 at step SC2 in FIG. 11 and obtains the rotational direction and the rotational amount of the image as the correction value of the two-dimensional correction from the bending amount of the sheet P at step SC3 in FIG. 11.

Meanwhile, although the operation of determining the correction value of the two-dimensional correction may be performed during the operation of forming the image on the first sheet, there is possibility that the image to be formed bends, so that it is preferable to perform this by operation in which the image is not formed, and it is preferable to use a waste sheet, for example.

When operation of forming an image on the subsequent sheets is started at step SC4 in FIG. 11, the registration swing is first performed on the sheet P. An image is transferred to the sheet P the inclination and the like of which is corrected by the registration swing by the intermediate transfer belt 17, so that the image is formed on the sheet P. After the registration swing is performed, while the sheet P is nipped to be conveyed by the registration roller 28, the image Pc is formed without the two-dimensional correction at step SC5 in FIG. 11.

When it is determined to be T seconds before the sheet P loses contact with the registration roller 28 at step SC6 in FIG. 11, the image to be transferred to the intermediate transfer belt 17 is rotated by the correction value of the two-dimensional correction obtained by using the preceding first sheet P and the like at step SC7.

When the two-dimensional correction to rotate the image formed on the sheet P is performed at the timing at which the sheet P loses contact with the registration roller 28, when the sheet P loses contact with the registration roller 28 at step SC8 in FIG. 11, the rear end side of the sheet P bends and the image Pc on which the two-dimensional correction is performed is formed on the sheet P at step SC9 in FIG. 11.

As a result, it is possible to obtain the correction value of the two-dimensional correction by using the preceding sheet P and to perform the two-dimensional correction on the sheet P on which an image is actually formed by using this correction value.

Figure 12:
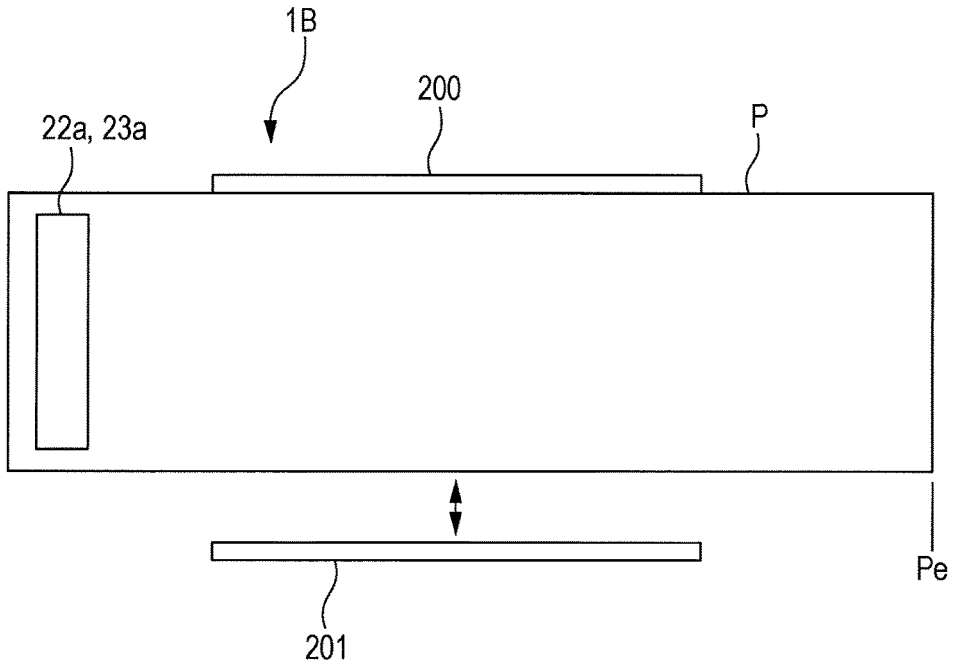
FIG. 12 is another configuration diagram illustrating a variation of the image forming apparatus of this embodiment.
Figure 13:
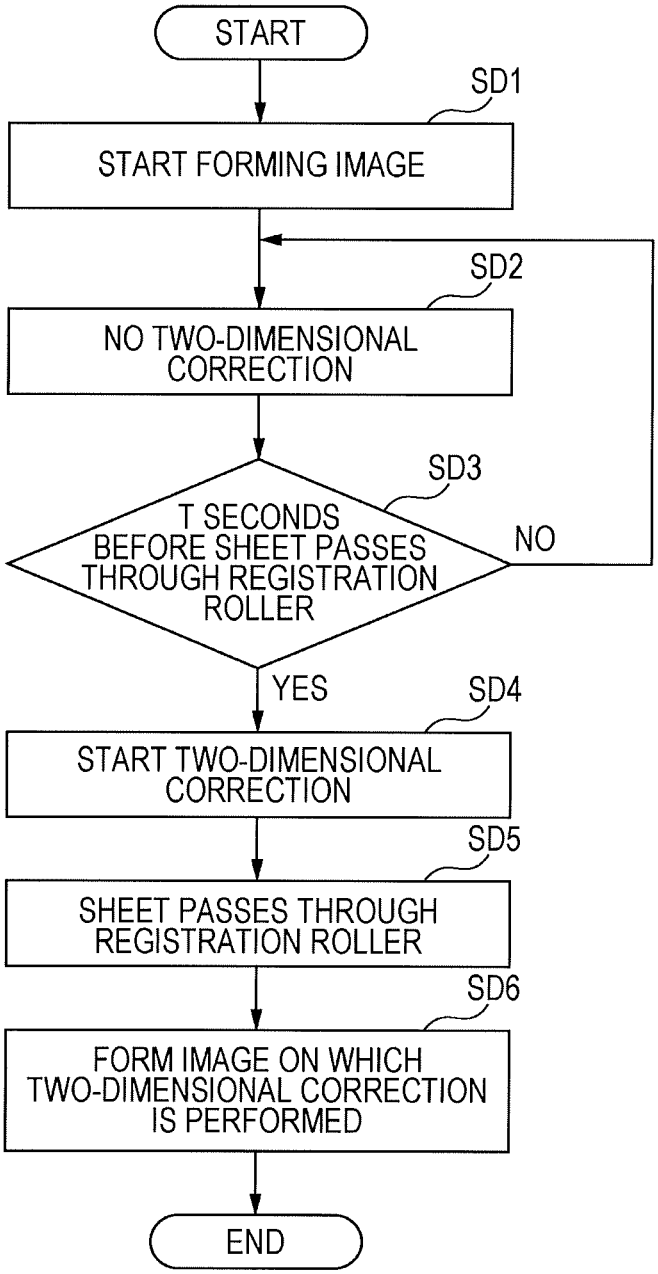
FIG. 13 is a flowchart illustrating another operation example of the image forming apparatus of this embodiment.

FIG. 12 is another configuration diagram illustrating a variation of the image forming apparatus of this embodiment, and FIG. 13 is a flowchart illustrating another operation example of the image forming apparatus of this embodiment. In the above-described embodiment, the configuration in which the inclination of the sheet P and the position in the main scanning direction thereof are corrected by the registration swing is described as an example. On the other hand, the present invention may also be applied to a configuration to correct the inclination of the sheet P and the position in the main scanning direction thereof by allowing a side end of the sheet P in a width direction to abut a guide member.

As illustrated in FIG. 12, an image forming apparatus 1B includes, as a pair of guide members, a fixed first regulating plate 200 and a second regulating plate 201 movable in a direction to come into contact with and separate from the first regulating plate 200.

The first regulating plate 200 and the second regulating plate 201 are provided in an external paper feeder 22 and a paper feed cassette 23. The first regulating plate 200 is opposed to one side end in the width direction of the sheet P in the main scanning direction of the image formed on the sheet P. The second regulating plate 201 is opposed to the other side end in the width direction of the sheet P.

The inclination and the position in the main scanning direction of the sheet P are corrected by adjustment of a position of the second regulating plate 201 such that one side end thereof abuts the first regulating plate 200.

The sheet P loaded in the external paper feeder 22 is conveyed by the paper feed roller 22*a* in a state in which the inclination and the position in the main scanning direction thereof are corrected by the first regulating plate 200 and the second regulating plate 201. Also, the sheet P loaded in the paper feed cassette 23 is conveyed by the paper feed roller 23*a* in a state in which the inclination and the position in the main scanning direction thereof are corrected by the first regulating plate 200 and the second regulating plate 201.

However, if the rear end Pe of the sheet P passes through the first regulating plate 200 and the second regulating plate 201 and passes through the registration roller 28, the sheet P might bend by an effect of the fixer 30 and the like. Therefore, the above-described two-dimensional correction is performed.

When the operation of forming an image is started at step SD1 in FIG. 13, until the read end Pe of the sheet P passes through the registration roller 28, the image Pc is formed without the two-dimensional correction at step SD2 in FIG. 13.

If it is determined to be T seconds before the rear end Pe of the sheet P passes through the registration roller 28 at step SD3 in FIG. 13, the image to be transferred to the intermediate transfer belt 17 is rotated by the correction value of the two-dimensional correction at step SD4.

When the two-dimensional correction to rotate the image formed on the sheet P is performed at the timing at which the rear end Pe of the sheet P passes through the registration roller 28, when the rear end Pe of the sheet P passes through the registration roller 28 at step SD5 in FIG. 13, the rear end side of the sheet P bends and the image Pc on which the two-dimensional correction is performed is formed on the sheet P at step SD6 in FIG. 13.

As a result, even when the sheet P bends because the rear end Pe of the sheet P corrected by the first regulating plate 200 and the second regulating plate 201 passes through the registration roller 28, the image Pc formed on the sheet P is inhibited from bending in midstream.

The present invention is applied to an image forming apparatus that forms an image by transferring and fixing a toner image to long paper.

Although embodiments of the present invention have been described and illustrated in detail, it is clearly understood that the same is by way of illustration and example only and not limitation, the scope of the present invention should be interpreted by terms of the appended claims.

What is claimed is:

1. An image forming apparatus comprising:

an image forming part that forms an image on a sheet;

a conveyor that conveys the sheet on which the image is formed by the image forming part;

a corrector including a swing member that moves the sheet conveyed by the conveyor in a main scanning direction of the image; and a hardware processor that rotates the image to be formed on the sheet after timing at which the swing member loses contact with the sheet when the swing member separates from the sheet or the sheet is conveyed to pass through the swing member in accordance with a bending amount of the sheet.

2. The image forming apparatus according to claim 1, wherein the image forming part includes:

a first image carrier on which an image is formed, and a second image carrier to which the image is primarily transferred from the first image carrier that secondarily transfers the primarily transferred image to the sheet, and the hardware processor rotates the image transferred to the second image carrier by the first image carrier before the timing at which the swing member loses contact with the sheet in accordance with a length from a position where the image is primarily transferred to the second image carrier by the first image carrier to a position where the second image carrier secondarily transfers the image to the sheet.

3. The image forming apparatus according to claim 1, wherein the hardware processor controls a rotational amount of the image to be formed on the sheet according to stiffness of the sheet.

4. The image forming apparatus according to claim 1, wherein the hardware processor delays timing to separate the swing member from the sheet after correcting operation of moving the sheet in the main scanning direction of the image is performed by the swing member.

5. The image forming apparatus according to claim 1, further comprising:

a detector that detects the bending amount of the sheet, wherein the hardware processor controls a rotational amount of the image to be formed on the sheet according to the bending amount of the sheet detected by the detector.

* * * * *